US006962570B2

(12) United States Patent
Callanan et al.

(10) Patent No.: US 6,962,570 B2
(45) Date of Patent: Nov. 8, 2005

(54) KNEE EXTENSION THERAPY APPARATUS

(75) Inventors: Keith E. Callanan, Stoughton, MA (US); K. Donald Shelbourne, 7418 N. Washington Blvd., Indianapolis, IN (US) 46240

(73) Assignee: K. Donald Shelbourne, Indianapolis, IN (US)

( * ) Notice: Subject to any disclaimer, the term of this patent is extended or adjusted under 35 U.S.C. 154(b) by 0 days.

(21) Appl. No.: 10/237,812

(22) Filed: Sep. 9, 2002

(65) Prior Publication Data

US 2004/0049135 A1 Mar. 11, 2004

(51) Int. Cl.[7] ..... A61H 1/02
(52) U.S. Cl. ..... 601/5; 601/34; 482/95
(58) Field of Search ..... 601/5, 23, 24, 601/33, 34, 35; 482/907, 95, 96; 602/33, 602/34, 35, 38, 39

(56) References Cited

U.S. PATENT DOCUMENTS 661,812 A * 11/1900 McKown et al. ..... 602/39
1,144,085 A * 6/1915 Abplanalp ..... 482/95
3,612,042 A * 10/1971 Fry ..... 601/24
4,100,918 A 7/1978 Glancy
4,362,151 A * 12/1982 Cottrell ..... 606/241
4,489,713 A * 12/1984 Latenser ..... 606/242
4,664,099 A * 5/1987 Pearl, Jr. ..... 602/35
4,665,905 A 5/1987 Brown
5,253,639 A * 10/1993 Johnston ..... 601/34
5,687,742 A 11/1997 Johnson
5,820,519 A * 10/1998 Slenker ..... 482/4
6,467,713 B1 * 10/2002 Watanabe et al. ..... 242/375.1
2003/0018287 A1 * 1/2003 Gilliam ..... 602/32

OTHER PUBLICATIONS

Information Health Network product brochure, "3×10=0 Full Extension Knee Devices", pp. 1-4, Rev. 4, Dec. 2002, Lansing, Michigan 48909.

* cited by examiner

*Primary Examiner*—Danton DeMille
(74) *Attorney, Agent, or Firm*—Woodard, Emhardt, Moriarty, McNett & Henry, LLP

(57) ABSTRACT

A knee extension therapy apparatus is described. The apparatus is designed for use by a patient in a recumbent position having the foot of his leg to be treated elevated to a level above the surface upon which the patient user is resting. The knee extension therapy apparatus can be collapsed for easy transport.

13 Claims, 5 Drawing Sheets

KNEE EXTENSION THERAPY APPARATUS

FIELD OF THE INVENTION

This invention relates to a device for physical therapy. More particularly, the invention is directed to a knee extension therapy apparatus that can be used by a patient without medical practitioner assistance.

BACKGROUND AND SUMMARY OF THE INVENTION

It is important that patients recovering from knee surgery initiate knee exercise/stretching therapy promptly after surgery to maintain knee joint flexibility and shorten the period for recovery. Patient compliance with a predetermined physical therapeutic protocol is key to early patient recovery with optimal joint flexibility and function. While there have been many devices developed to provide knee extension and exercise therapy, each has its complexities or difficulties of use that have tended to reduce patient compliance with therapeutic protocols designed for early and effective recovery.

The present invention provides a knee extension therapy apparatus that can be easily transported for patient home use, and one that can be used by the postoperative or post-trauma patient with minimal instruction and without assistance of attending medical practitioners, family members or friends. The present invention provides a simple, effective, user adaptable knee extension therapy device. The device is configured to allow the patient to lie in a comfortable recumbent position during each therapy session. That, coupled with an easy-to-use force translation pulley system for efficient and effective delivery of knee straightening forces to areas on the top of the patient's leg and areas of the shin and thigh, constitutes significant improvement over knee extension therapeutic devices that previously have been available.

There is provided in accordance with this invention a knee extension therapy apparatus for use by a patient in a recumbent position. The patient's hip corresponding to that of the leg requiring therapy rests on the surface of a base component of the device. The leg requiring extension therapy is elevated to a level above the surface upon which the patient user is resting and is held in position by a height adjustable elevated ankle support. The apparatus is preferably designed to be collapsible into an easily transported unit so that it can be used by the patient at home. The device includes a base having a patient user proximal surface for supporting the patient user's hip and a user distal portion. The apparatus also includes an ankle support member, preferably one of adjustable height mounted on a user distal portion of the base. The apparatus also includes a pulley system for translating a forced supply toward the user proximal end of the base and having a major vector component parallel to the surface of the base to a force having a major vector component substantially orthogonal to the base. The pulley system is designed to maintain the tension in the system resulting from the patient applied force. In one embodiment the pulley system enables the applied force to be translated into a mechanically advantaged force having a major component substantially orthogonal to the base. The device also includes a force transmitting element for engaging both knee proximal and knee distal portions of the patient's elevated leg. The force transmitting element has at least one user engageable/disengageable connector for attaching the element to the pulley system for applying the translated basedorthogonal force to areas on the upper surface of the patient's elevated leg proximal and distal of the elevated knee which applied forces tend to straighten the leg and extend the knee joint.

In one embodiment the knee extension therapy apparatus can be collapsed into a compact easy transported unit. In that embodiment the ankle support member is typically pivotally mounted on the user distal portion of the base and can be locked either in an upright apparatus use position or in a folded apparatus transport position. In addition, the base can be formed in two parts: a first user proximal portion and a second user distal portion wherein said portions are hingedly connected so that the user proximal portion of the base can be rotated so that the respective undersides of the user proximal and user distal portions of the base can be contacted in a apparatus transport position. In one embodiment the force transmitting element of the apparatus of the present invention comprises first and second leg straps for engaging knee proximal and knee distal portions of the patient's elevated leg, respectively, each strap having at least one user engageable/disengageable connector for attaching the straps to the pulley system. In one embodiment the leg straps have first and second user engageable/disengageable connectors for their attachment to the pulley system.

In one embodiment of the invention the pulley system comprises a line cord threaded through a main pulley mounted on the user distal portion of the base and connected to a line cord anchor located at a position intermediate to user proximal and user distal portions of the base. The pulley system typically also includes a ratcheted pulley hook attached to the line cord and a line tensioning pull cord engaged with said ratcheted pulley for applying tension to the line cord and thus the pulley system and the connected leg straps when the device is in use. The pulley system also comprises a plurality of pulley hooks positioned between the main pulley and the line cord anchor and between the line cord anchor and at least first and second line cord guides or pulleys attached to the base. Each of the pulley hooks is adapted for attachment to a connector on one or both ends of the leg straps (force transmitting elements). In one preferred embodiment the pulley system includes right hand and left hand line cords, each anchored on one end and engaged with the main pulley on and the other end connected to a ratcheted pulley hook, itself operatively engaged with a line tensioning pull cord. In one embodiment the non-anchored ends of the line cords are threaded through a line cord guide attached to the base at a position generally under the thigh of the patient's elevated leg and intermediate between the lateral edges of the base. Anchors for the line tensioning pull cord are typically located on each of the lateral edges of the user proximal portion of the base so that the pulley system can be easily utilized by patients whether they are right-handed or left-handed. Thus the line tensioning pull cord is anchored on the left lateral edge of the user proximal portion of the base when the device is set up for use by a left-handed patient user, and the tensioning pull cord is anchored at or near a right lateral edge of the user proximal portion of the base when the apparatus is set up for therapeutic use by a right handed patient user.

The pulley system can comprise either one or at least two (one for the right side and one for the left side) line cords carrying pulley hooks for connection with the leg straps for device operation. Again, the untethered end of the line cord(s) is attached to a ratcheted pulley hook operatively engaged with a line tensioning pull cord for applying force to and maintaining the resultant tension in the pulley system.

DETAILED DESCRIPTION OF THE PREFERRED EMBODIMENTS

Figure 2:
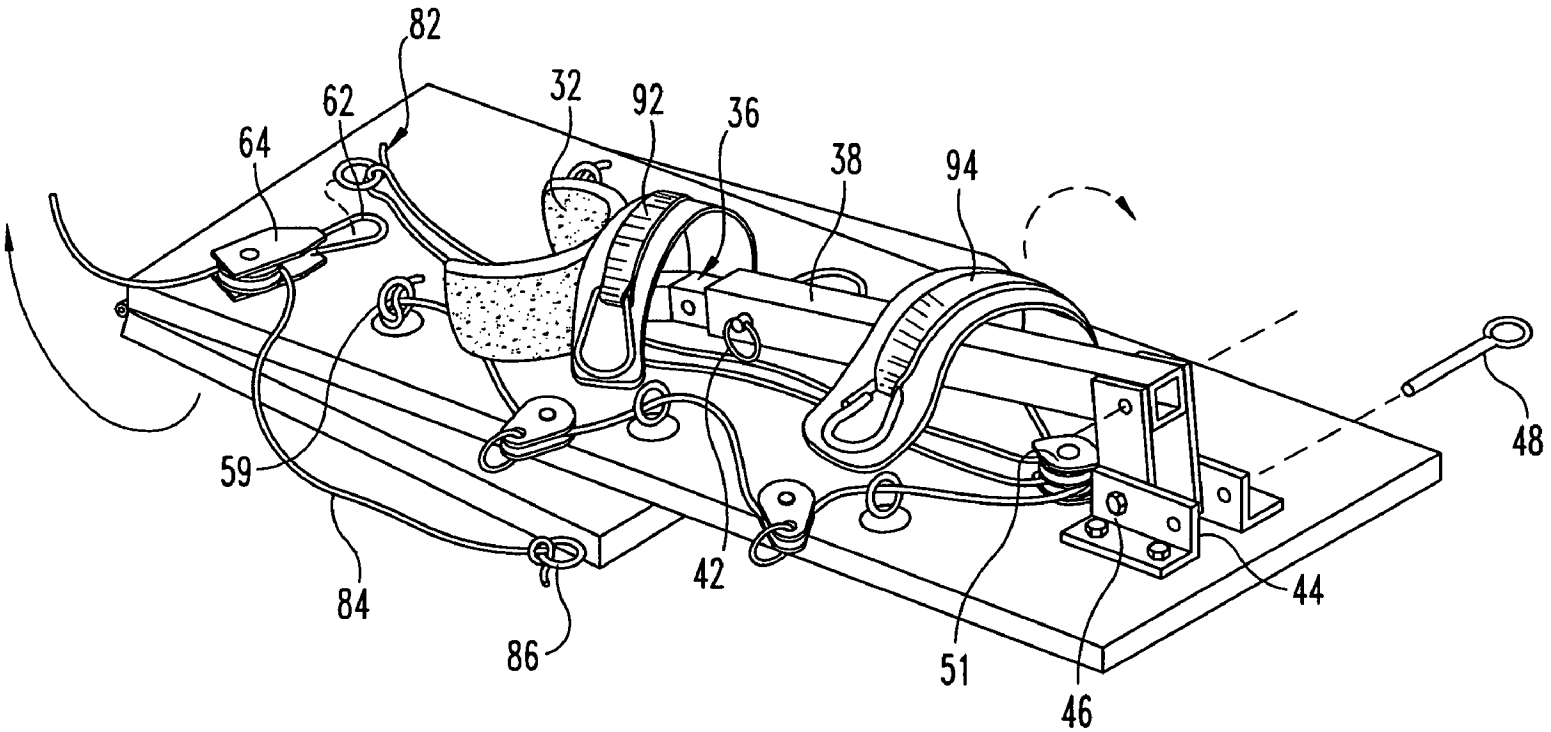
FIG. 2 illustrates the apparatus of FIG. 1 folded in a configuration for easy transport.

With reference to FIGS. 1–4, there is provided in accordance with this invention a knee extension therapy apparatus 10 for use by patient 12 lying in a recumbent position with his foot 14 elevated to a level above the surface 16 upon which patient user 12 is resting. The apparatus includes a base 18 having a patient user proximal surface 16 for supporting patient user's hip 20, and base 18 includes a user distal portion 22, an ankle support member 30 including a U-shaped ankle support 32 and a support post 34. The support post is of adjustable height having an inner post unit and an outer post unit 38 wherein inner post unit is telescopically received in it outer post unit 38 to allow height adjustment of U-shaped or, more preferably, V-shaped ankle support 32. A height adjustment locking pin 42 is used to engage aligned apertures in the inner post unit 36 and outer post unit 38 to lock the ankle support member 30 to a patient preferred height. Ankle support member 30 is pivotally mounted to support post mounting 44 using support post pivot pin 46 and pivot locking pin 48. As illustrated in FIG. 2, pivot locking pin 48 can be removed to allow the ankle support member 30 to be rotated into a device storage position.

The knee extension therapy apparatus 10 also includes a pulley system 50 for translating and maintaining a force 70 applied toward the user proximal end 21 of the base 18 (using tensioning pull cord 84) and having a major vector component generally parallel to the surface 16 of the base to a force having a major vector component 80 substantially orthogonal to the surface of the base 18. The pulley system 50 includes line cords 56,57 extending from line cord anchors 58,59 respectively, through main pulley 51, and through optional line cord guides 52,53 (FIG. 1A) and connected to hook 62 of ratcheted pulley 64. Between line cord anchor 58 and main pulley 51, line cord 56 is threaded through line cord guides 66,67 and through pulley hooks 74,75. Similarly, line cord 59 is threaded through line cord guides 68,69 and pulley hooks 76,77. Unanchored ends 82 of line cords 56,57 are attached to hook 62 of the ratcheted pulley hook 64. A tensioning pull cord 84 is threaded through ratcheted pulley 64 and anchored to tensioning pull cord anchor 86. A second tensioning pull cord anchor 88 is located on the opposite (left hand) edge of the user proximal portion of base 18 to facilitate use of the device by left handed patient users. In that case tensioning pull cord 84 is anchored to tensioning pull cord anchor 88. In another embodiment not shown, anchors 86,88 are located at either end of an anchor plate extending the width of base 18 and affixed to the user proximal end 21 of base 18.

Force transmitting element 90 in the form of knee proximal leg strap 92 and knee distal leg strap 94 are provided for transmitting base-orthogonal directed force 80 to the top of the patient's leg at a knee proximal position 102 and a knee distal position 104. Each leg strap 92,94 includes a user engageable/disengageable connector 110 at each end for connection to pulley hooks 76,77 and 74,75. Alternatively the pulley hooks can be designed to include a user engageable/disengageable connector (not shown) for releasable attachment to grommets or ring hooks at the ends of the leg straps. In another alternative embodiment not shown in the drawings, each of leg straps 92,94 have a user engageable/disengageable connector only on one end, the other end being more or less permanently attached to the respective pulley hooks.

Figure 1:
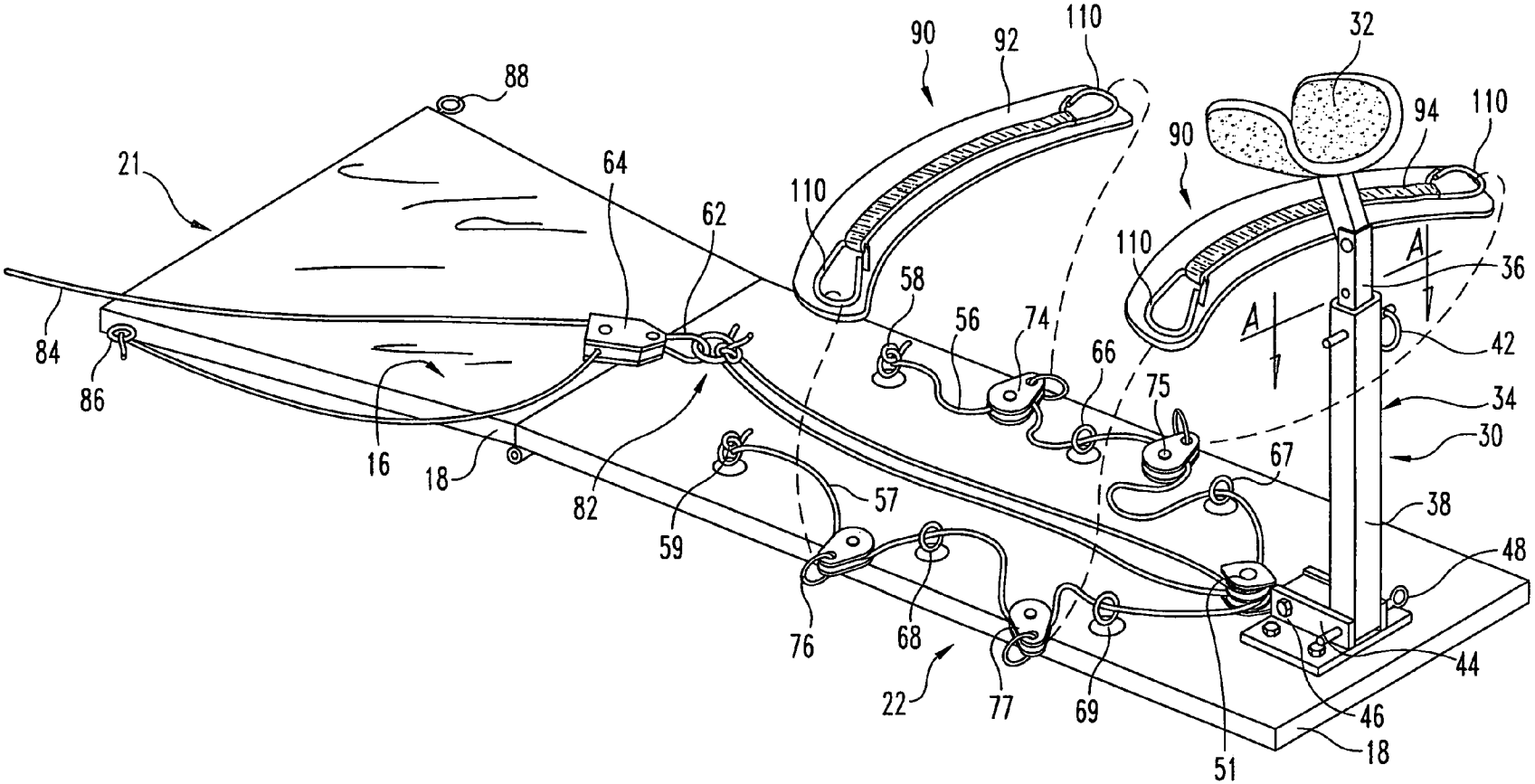
FIG. 1 is a perspective view of a knee extension device in accordance with the present invention.
Figure 1A:
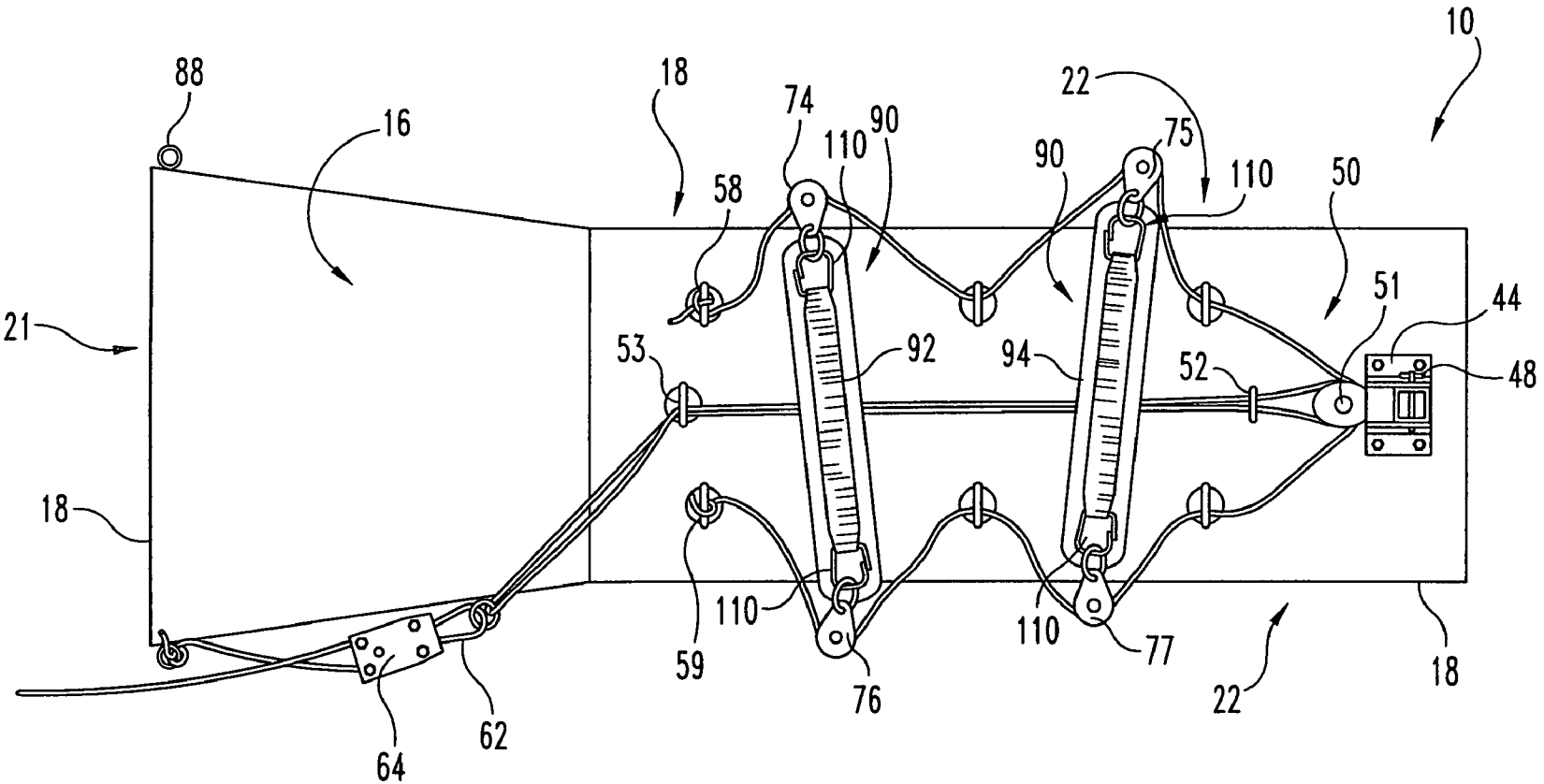
FIG. 1A is plan view of the apparatus illustrated in FIG. 1 partially broken away and with the leg straps connected to the pulley system.
Figure 3:
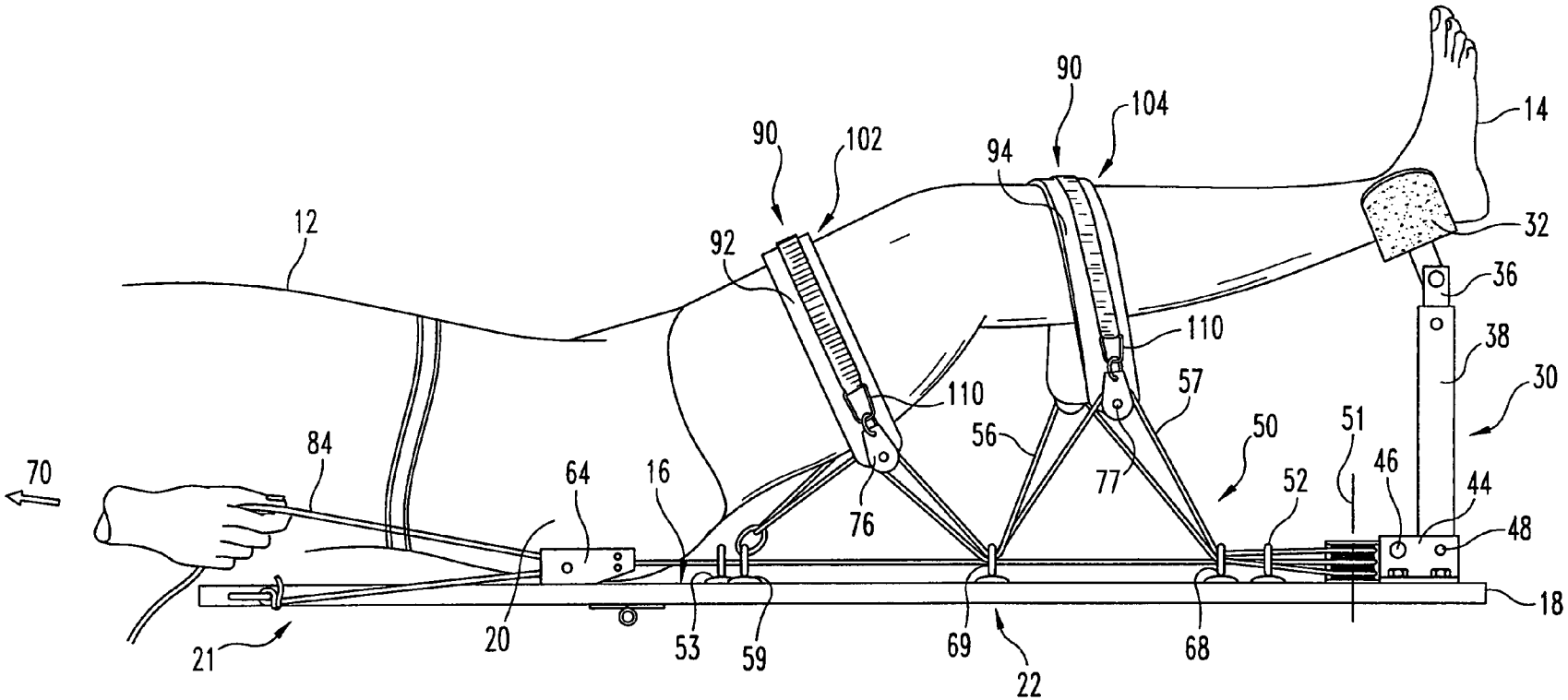
FIG. 3 illustrates use of the device shown in FIG. 1 by a patient in a recumbent position.
Figure 4:
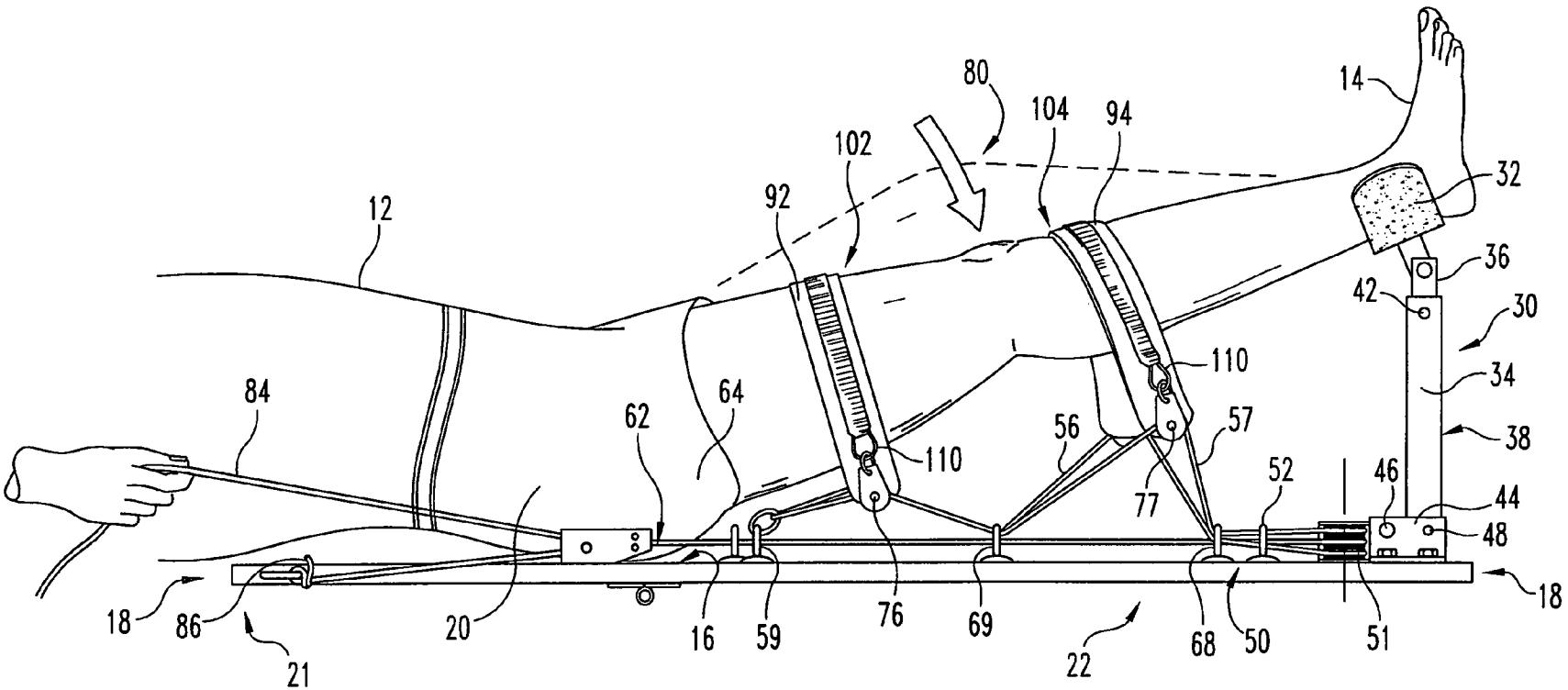
FIG. 4 is similar to FIG. 3 showing the effect of the force applied to the top of the patient's leg using the device illustrated in FIG. 1 by user applied force to the line tensioning pull cord.

With reference particularly to FIGS. 1A, 3 and 4, the knee extension therapy apparatus 10 is readied for patient use by unhooking at least pulley hooks 74,75 from their respective leg strap connectors 110. The height of the ankle support member 30 is set to a height comfortable for the patient. The patient positions the hip corresponding to the leg requiring knee extension therapy on surface 16 of the user proximal portion of base 18 and rest the ankle of the leg undergoing therapy in U-shaped ankle support 32. Leg straps 92,94 are then lifted over the top of the respective knee proximal position 102 and knee distal position 104 of the patient's leg and their respective connectors 110 are engaged with pulley hooks 74,75, respectively. The patient assumes a recumbent position and applies force 70 to tensioning pull cord 84 to apply knee straightening force 80 to the top of the patient's leg requiring knee extension therapy. Periodically the patient, while remaining in a recumbent position, applies additional tensioning force to the pulley system 50 by applying force 70 to tensioning pull cord 84 to apply tensioning force to the pulley system through ratcheted pulley hook 64 which works to maintain the applied tension on pulley system 50 and concomitantly on leg straps 92,94 in contact with the patient's leg undergoing extension therapy. The procedure is repeated until the desired degree of knee extension is achieved. The knee extension therapy can be applied periodically to achieve enhanced flexibility in the force extended.

The present invention has been described with reference to the appended drawings and such description is for illustrative purposes only. The invention is not intended to be limited by the preferred embodiments illustrated in the drawings. Those skilled in the art will appreciate that the scope of the invention extends to other comparable embodiments.

What is claimed is:

1. A knee extension therapy apparatus for use by a patient in a recumbent position with his foot elevated to a level above the surface upon which the patient user is resting, said apparatus comprising a base having a user distal portion and a patient user proximal portion with surface for supporting the patient user's hip;

an ankle support member mounted on the user distal portion of the base, said ankle support member being height adjustable and being pivotally mounted for positioning between an upright patient ankle support position and a folded storage position;

a pulley system for translating a force applied by the patient toward the patient proximal end of the base and having a major vector component generally parallel to the surface of the base to a force having a major vector component substantially orthogonal to the surface of the base, said pulley system including pulley means for maintaining a patient predetermined force setting, absent continued patient interaction; and a force transmitting element for engaging both knee proximal and knee distal portions of the patient's elevated leg, said element having at least one connector for attaching said element to the pulley system for applying the translated base-orthogonal force to the top of the patient's leg toward said base.

2. The apparatus of claim 1 wherein the force transmitting element comprises first and second leg straps for engaging knee proximal and a knee distal portion of the patient's elevated leg, each strap having at least one patient engageable/disengageable connector for attaching said straps to the pulley system.

3. The apparatus of claim 2 wherein the leg straps have first and second patient engageable/disengageable connectors of their attachment to the pulley system.

4. A knee extension therapy apparatus for use by a patient in a recumbent position with his foot elevated to a level above the surface upon which the patient is resting, said apparatus comprising a base having a patient distal portion and a patient proximal portion with a surface for supporting the patient's hip;

an ankle support member mounted on the patient distal portion of the base;

a pulley system for translating a force applied by the patient toward the patient proximal end of the base and having a major vector component generally parallel to the surface of the base to a force having a major vector component substantially orthogonal to the surface of the base, said pulley system being constructed and arranged for maintaining a patient predetermined force setting, absent continued patient interaction, said pulley system including a line cord, a main pulley mounted on the patient distal portion of the base, and operatively engaging said line cord, and a line cord anchor located at a position intermediate the patient proximal and patient distal portions of the base; and a force transmitting element for engaging both knee proximal and knee distal portions of the patient's elevated leg, said element having at least one connector for attaching said element to the pulley system for applying the translated base-orthogonal force to the top of the patient's leg toward said base.

5. The apparatus of claim 4 wherein the pulley system further comprises a ratcheted pulley hook attached to the line cord and a tensioning pull cord operatively engaged with said ratcheted pulley for applying tension to the line cord.

6. The apparatus of claim 4 wherein the pulley system comprises a plurality of pulley hooks positioned between the main pulley and the line cord anchor, each of said pulley hooks adapted for attachment to a connector on the force transmitting element.

7. The apparatus of claim 6 wherein the pulley hooks include a user engageable/disengageable connector for attachment to the force transmitting element.

8. The apparatus of claim 6 wherein there are right and left line cords and the main pulley is adapted to operatively engage with each of the line cords.

9. The apparatus of claim 5 wherein the tensioning pull cord is anchored to the user proximal portion of the base.

10. The apparatus of claim 8 having right and left pull cord anchors on the patient proximal portion of the base.

11. The apparatus of claim 4 wherein the portion of the line cord used for applying the tension to the pulley system is threaded through a line cord guide attached to the base at a position generally under the thigh of the patient's elevated leg.

12. A knee extension therapy apparatus for use by a patient in a recumbent position with his foot elevated to a level above the surface upon which the patient is resting, said apparatus comprising a base having a patient distal position and a patient proximal position with a surface for supporting the patient's hip;

a height adjustable ankle support member mounted on the patient distal portion of the base, said ankle support member being pivotally mounted for positioning between an upright patient ankle support position and a folded storage position;

a pulley system for translating a force applied by the patient toward the patient proximal end of the base and having a major vector component generally parallel to the surface of the base to a force having a major vector component substantially orthogonal to the surface of the base; and a force transmitting element for engaging both knee proximal and knee distal portions of the patient's elevated leg, said force transmitting element having at least one connector for attaching said force transmitting element to the pulley system for applying the translated base-orthogonal force to the top of the patient's leg toward said base.

13. A knee extension therapy apparatus for use by a patient in a recumbent position with his foot elevated to a level above the surface upon which the patient is resting, said apparatus comprising a base having a patient distal position and a patient proximal position with a surface for supporting the patient's hip;

an ankle support member mounted on the patient distal portion of the base;

a pulley system for translating a force applied by the patient toward the patient proximal end of the base and having a major vector component generally parallel to the surface of the base to a force having a major vector component substantially orthogonal to the surface of the base, said pulley system including a line cord, a main pulley mounted on the patient distal portion of the base, and operatively engaging said line cord, and a line cord anchor located at a position intermediate the patient proximal and patient distal portions of the base; and a force transmitting element for engaging both knee proximal and knee distal portions of the patient's elevated leg, said force transmitting element having at least one connector for attaching said force transmitting element to the pulley system for applying the translated base-orthogonal force to the top of the patient's leg toward said base.

* * * * *